US011590039B1

(12) United States Patent
Britz

(10) Patent No.: US 11,590,039 B1
(45) Date of Patent: Feb. 28, 2023

(54) WHEELCHAIR PROPULSION ASSIST DEVICE

(71) Applicant: John W. Britz, Export, PA (US)

(72) Inventor: John W. Britz, Export, PA (US)

( * ) Notice: Subject to any disclaimer, the term of this patent is extended or adjusted under 35 U.S.C. 154(b) by 0 days.

(21) Appl. No.: 17/683,693

(22) Filed: Mar. 1, 2022

(51) Int. Cl.
*A61G 5/02* (2006.01)
*A61G 5/10* (2006.01)

(52) U.S. Cl.
CPC ..... *A61G 5/025* (2013.01); *A61G 5/1016* (2013.01)

(58) Field of Classification Search
CPC ..... A61G 5/025; A61G 5/022; A61G 5/028
See application file for complete search history.

(56) References Cited

U.S. PATENT DOCUMENTS 3,877,725 A * 4/1975 Barroza ..... B62M 1/16 280/250.1
4,453,729 A 6/1984 Lucken
4,735,431 A 4/1988 Tait
4,811,964 A 3/1989 Horn
5,988,661 A * 11/1999 Garfinkle ..... A61G 5/025 280/244
6,889,991 B1 5/2005 Facer et al.
7,296,811 B2 * 11/2007 Pettit ..... A61G 5/022 280/247
7,520,519 B2 4/2009 Smurthwaite
7,837,210 B2 11/2010 Kylstra et al.
10,548,785 B2 2/2020 Vermij et al.
10,722,409 B2 7/2020 Robins
2002/0043781 A1 * 4/2002 Mitchell ..... A61G 5/025 280/253
2002/0145271 A1 10/2002 Sanchez
2009/0283982 A1 11/2009 Thomas
2012/0186764 A1 7/2012 Bayne et al.
2012/0267873 A1 * 10/2012 Joo ..... A61G 5/025 280/250.1

OTHER PUBLICATIONS

Scire Community Team; Wheelchair Propulsion Assist Devices; Jang, Sharon; May 15, 2020; scireproject.com/community/topic/propulsion-assist-devices.

* cited by examiner

*Primary Examiner* — Kevin Hurley
*Assistant Examiner* — Harold Eric Pahlck, III
(74) *Attorney, Agent, or Firm* — Karen Tang-Wai Sutton

(57) ABSTRACT

A propulsion assist device for a wheelchair having a hand rim slideably housed inside a channel of a frame pivotably connected to a lever arm. The frame is further comprised of a portion of grip material positioned inside the channel along an underside of a top of the frame. When a pair of devices are installed on a pair of hand rims of the wheelchair, the wheelchair is moved forward by a coordinated rowing motion of both lever arms forwards and then backwards along the hand rim. The pivoting motion of the frame causes the grip material sandwiched between the frame and the hand rim to pressure grip the hand rim and turn it when a user moves the lever arms through their rowing motion. Repositioning the frame along the hand rim causes the gripping material to release and slide along the hand rim before repositioning.

11 Claims, 15 Drawing Sheets

WHEELCHAIR PROPULSION ASSIST DEVICE

CROSS-REFERENCE TO RELATED APPLICATIONS

NA

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The present invention relates to manually propelled wheelchairs. More particularly, the present invention relates to a non-motorized wheelchair propulsion device.

Background Art

People of all ages and health profiles routinely rely on wheelchairs for their daily mobility needs. Important wheelchair selection criteria include size and weight of the chair, maneuverability, the ability to fold or lift the chair to store in a car trunk, the method by which the wheelchair is propelled, and the costs associated with purchasing the wheelchair as well as maintaining it. The ideal wheelchair is lightweight, foldable, maneuverable, easy to propel, inexpensive and easy to maintain. However, this ideal wheelchair design thus far has proven elusive.

Two main wheelchair designs are currently available: electric drive and manual propulsion. Electric drive wheelchairs use a motor and drive unit to operate the chair and are larger, heavier, less maneuverable, and expensive. The wheelchair user controls the chair's motor with a lever or button controls, and thus propulsion and maneuvering of the wheelchair is effortless, requiring very little physical exertion by the user. Unfortunately, these electric wheelchairs are so bulky they often cannot fit into standard bathrooms in private homes, have limited maneuverability in tight spaces, and require specially adapted lifts and gates as well as vehicles to transport the chair, which is often cost prohibitive to the chair user. Electric wheelchairs, given their expense, are subject to theft and potential damage when being transported. These chairs also have batteries that must be recharged and replaced. Hence, many people who have an electric wheelchair for daily use still often have a manual wheelchair for "outside" use or travel, or even for use within their houses when the electric wheelchair is too large or otherwise bulky to maneuver though specific areas of the house. For instance, a house without an elevator usually has a wheelchair on each floor of the house and few people can afford to have multiple electric wheelchairs, thus typically the second wheelchair is in fact a manually propelled one.

Manually propelled wheelchairs have one significant drawback with their design: the push or hand rim affixed to the outermost side of each rear wheel is both non-ergonomic and requiring significant arm strength to propel the chair even for short distances. To move forward or backwards, the user grabs the hand rim and either pushes or pulls the rim to turn the wheels in the desired direction. This repetitive motion causes significant strain on the arm and shoulder and can cause injury. Manually propelled wheelchairs are also not suitable for those with arm injuries or otherwise lack physical strength to use the hand rim. Ironically, people who already have physical limitations and need a wheelchair to replace ambulatory mobility discover the wheelchair design itself creates more life limitations, including isolation, dependency on other people, and the overall diminishing of the wheelchair user's independence and quality of life.

Despite existing physical limitations, most people who depend on wheelchairs on a daily basis look for ways to get exercise and thus seek manual propulsion assist devices allowing for easier manual operation of the wheelchair. The majority of manual propulsion assist devices are in fact new wheelchair designs meant to replace the classic existing wheelchair with the hand rims, and thus unsuitable for those wishing to retrofit their existing wheelchairs. These new wheelchair designs are complicated, require new and potentially professional maintenance of the parts, add extra weight, and do nothing to help out a wheelchair owner who does not want to purchase a new chair. These designs are ideally most suited for someone wanting to purchase a new chair. For instance, U.S. Pat. No. 7,520,519 to Smurthwaite, uses a transmission having multiple drive wheels operated by a lever handle attached directly to each of the rear wheels, with direction of the wheels reversed by reversing the pawls within the transmissions, and best shown in FIG. 2. Three forward and one reverse speed are provided, as well as a neutral position, and disc brakes. The transmission is about the size of a bicycle hub. Note that even if the transmission was sold in a kit for installation on existing wheelchairs, it would realistically require professional installation.

U.S. Pat. No. 4,453,729 to Lucken similarly uses a ratchet system on the rear drive wheels and handles to allow the wheelchair user to propel forwards or backwards. While simpler than Smurthwaite, Lucken still describes a new wheelchair and is not suitable for retrofitting an existing chair.

U.S. Pat. No. 4,735,431 to Tait adds an upper drive wheel located approximately behind the arm rests of the chair, with the main rear drive wheels resized smaller and relocated further rearwards and approximately below the upper drive wheel, the sets of wheels connected using a chain as shown in FIG. 1. Tait is not capable of being retrofitted to an existing wheelchair and further, this design eliminates the hand rim completely, which if anything goes wrong with the new drive wheel system, the wheelchair user has no way of manually moving the chair at all.

U.S. Pat. No. 4,811,964 to Horn is another new wheelchair design with a rowing level pivotally connected to the wheelchair frame, with a steering shaft with a handlebar grip mounted coaxially within the rowing lever, with a pair of ratcheted sprockets mounted on the back axle with a pair of sprocket chain segments connected by cables through pulleys to the rowing lever to allow the rowing motion to engage the ratches with the axles for propulsion.

Similarly, U.S. Pat. No. 6,889,991 to Facer, U.S. Pat. No. 7,837,219 to Kylstra, U.S. Pat. No. 10,548,785 to Vermij, U.S. Pat. No. 10,722,409 to Robins, US publication no. 2009/0283982 A1 to Thomas, and US publication no. 2012/0187649 to Bayne all detail new wheelchair designs with many parts that are either completely unsuitable for retrofitting an existing wheelchair, or which require extensive modification of an existing wheelchair as to be impractical for a wheelchair user. US publication no. 2002/0145271 A1 to Sanchez details a wheelchair and power booster assembly for converting an existing wheelchair, however, it requires the wheelchair owner to essentially disassemble the entire chair and rebuild it using the kit, which again is highly impractical and unrealistic.

What is needed is a simple manual wheelchair propulsion assist device that has few parts that require servicing, is easy and intuitive to use requiring no extensive training or learning period, can be added to an existing wheelchair easily without requiring major modifications thereto, is lightweight and removable, allowing the user to keep the assist device on the wheelchair or remove it as desired without the need of tools for the removal, and is moderately priced so as to be affordable.

DISCLOSURE OF INVENTION

In a first aspect of the invention, a propulsion assist device for a wheelchair having a manual hand rim affixed to a drive wheel of the wheelchair, the propulsion assist device having a pair of lever arms each with an upper end and a lower end, the lower end formed with a lower aperture. At the lower end of each lever arm, a frame is pivotably secured thereto by way of a flange having a flange hole, and a fastener coupling the flange to the lower end through their respective hole and aperture. Each lever arm pivots forwards and backwards about its respective fastener affixed to each frame. The frame is further comprised of a top affixed to a pair of opposed side walls in spaced apart relationship, with an underside of the top and the spaced apart relationship of the side walls defining a channel sized and shaped to receive the manual hand rim. A portion of grip material is positioned on the underside of the top inside the channel.

In a second aspect of the invention, an upper end of the each lever arm is comprised of a handle sized and shaped to be gripped by a human hand and allow a user to ergonomically push and pull the lever arms in a rowing-like motion.

In a third aspect of the invention, the lever arm is further comprised of a telescopically adjustable upper arm and a lower arm, whereby a total length of the lever arm is adjustable.

In a fourth aspect of the invention, each of the side walls is formed with a bottom lip in spaced apart relationship with one another so as to create a gap between the bottom lips.

In a fifth aspect of the invention, a replacement rim having a flattened profile adapted to replace an original manufacturer hand rim of the wheelchair using existing fasteners of the original manufacturer hand rim is included and is sized and shaped to fit into the chamber of the frame. The frame is positioned onto the replacement rim by positioning the rim inside the gap between the bottom lips and rotating the replacement rim into place, or alternatively by removing one or both side walls, positioning the replacement rim against the underside of the top, and replacing the side walls.

In a sixth aspect of the invention, a propulsion assist kit for a manual wheelchair having a hand rim is included, the kit comprising a lever arm with an upper handle end and an opposed lower flange, and a c-shaped frame pivotably affixed to the lower flange. The c-shaped frame is further comprised of a channel sized and shaped to slideably receive the hand rim. A kit with an optional replacement rim with a flattened rim profile sized and shaped to replace an existing hand rim of a manual wheelchair is included, with the replacement rim affixed to a drive wheel of the wheelchair using existing fasteners or new fasteners included in the kit.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
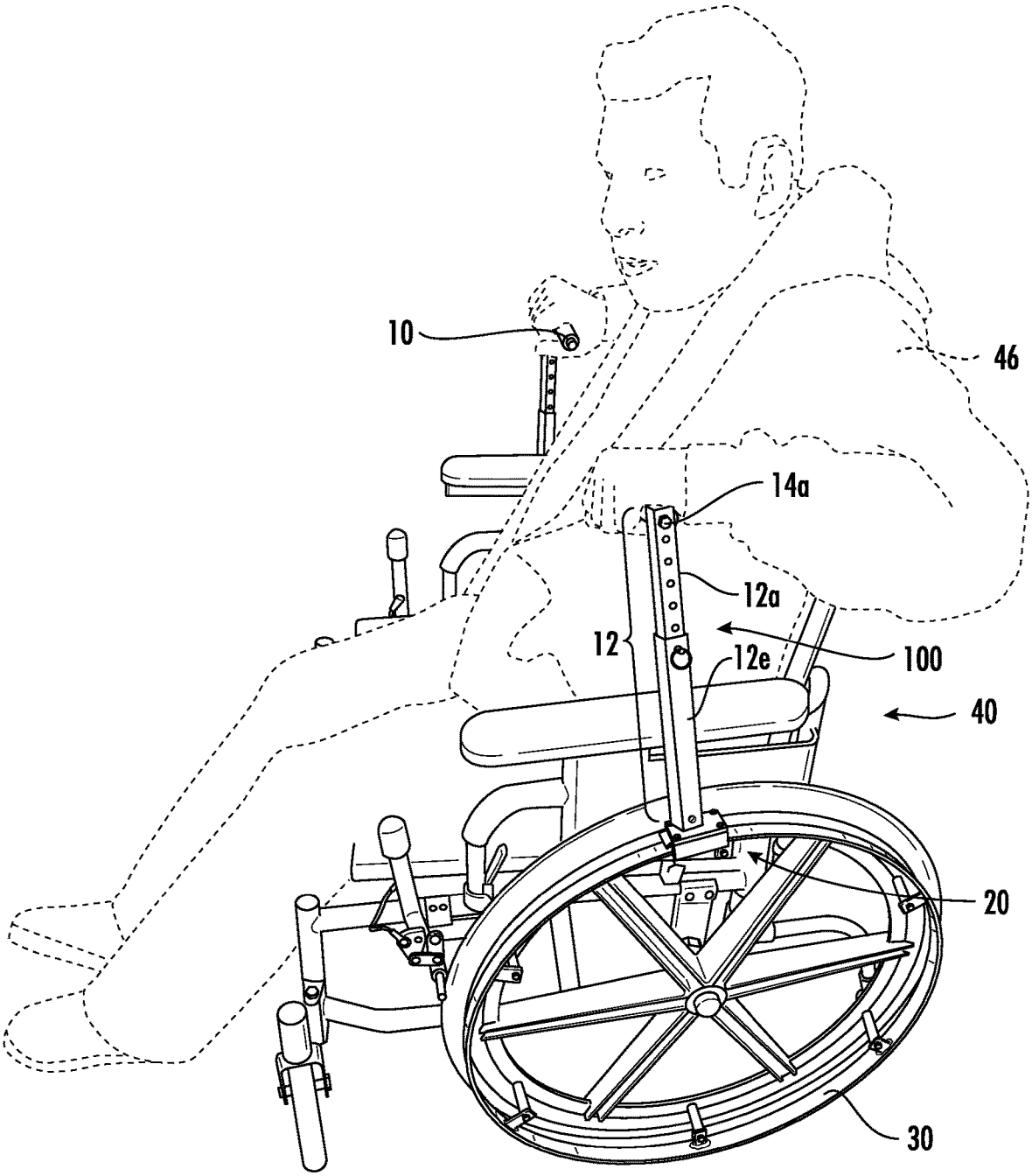
FIG. 1 is a perspective view of a wheelchair propulsion assist device according to the invention, shown installed on a manual wheelchair.
Figure 2:
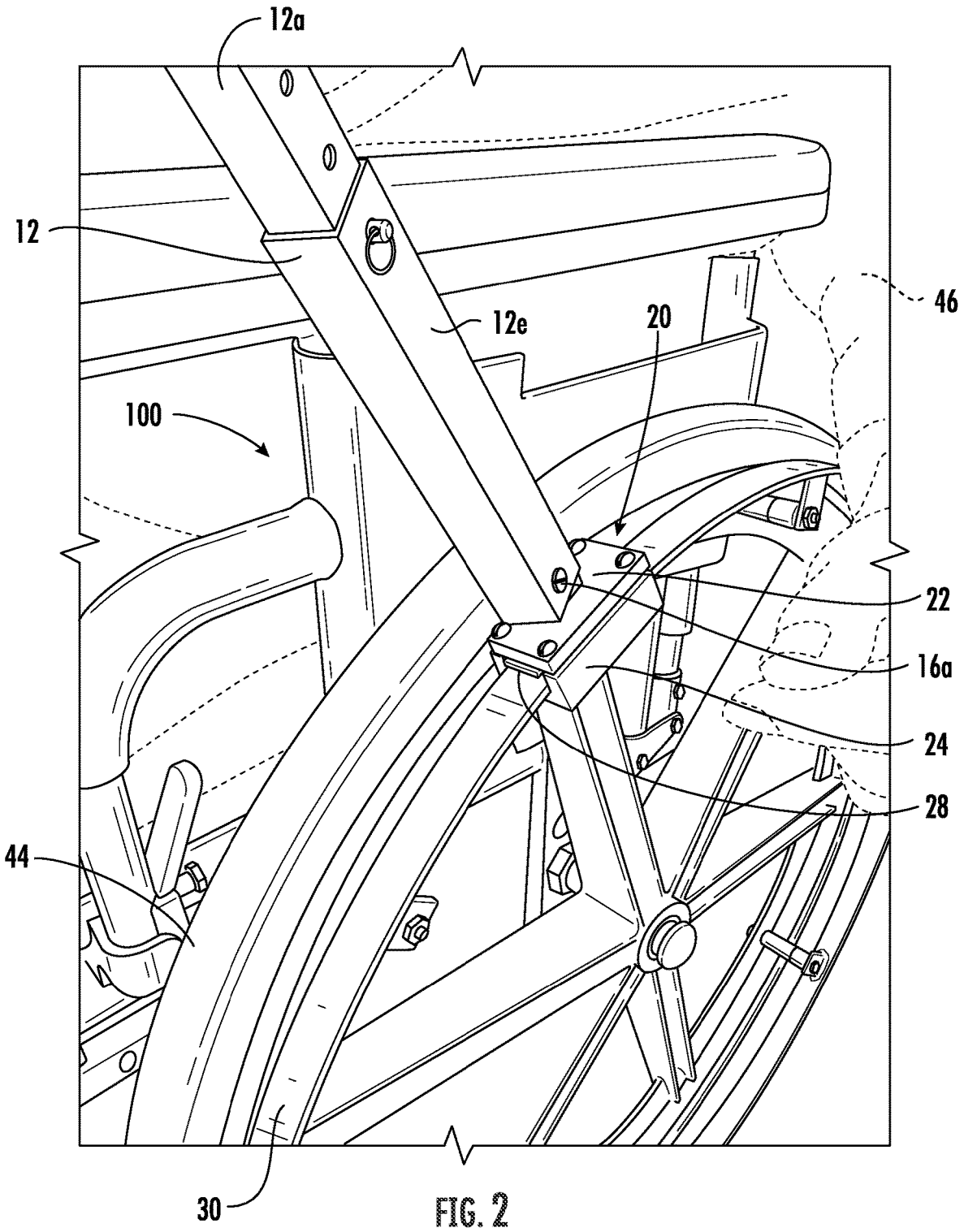
FIG. 2 is a perspective detail view of the wheelchair propulsion assist device in FIG. 1.
Figure 3:
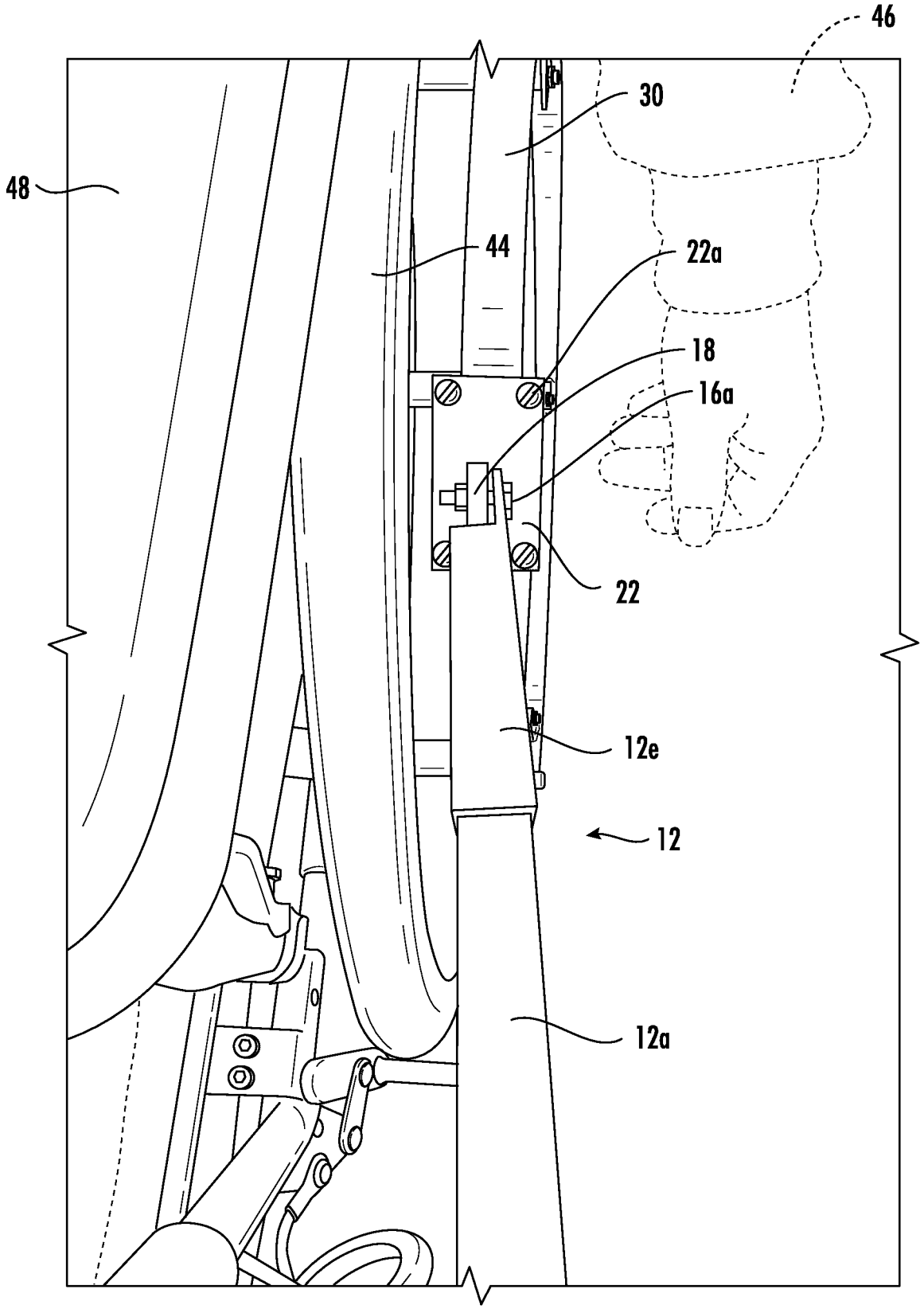
FIG. 3 is a top view of the wheelchair propulsion assist device in FIG. 1, shown with a lever arm extended in a forward facing direction.
Figure 4:
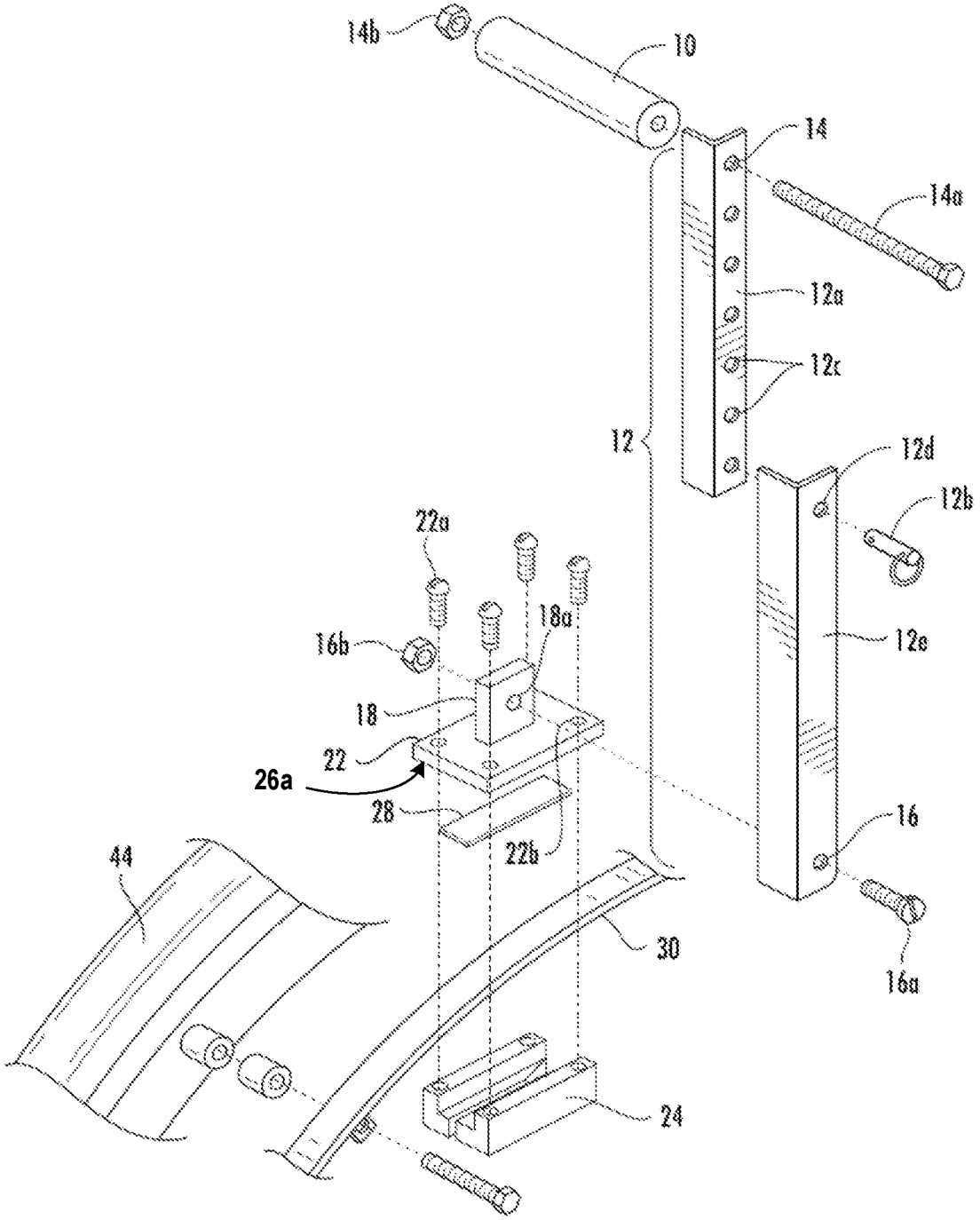
FIG. 4 is an exploded view of the wheelchair propulsion assist device according to the invention, shown with an optional hand rim.
Figure 5:
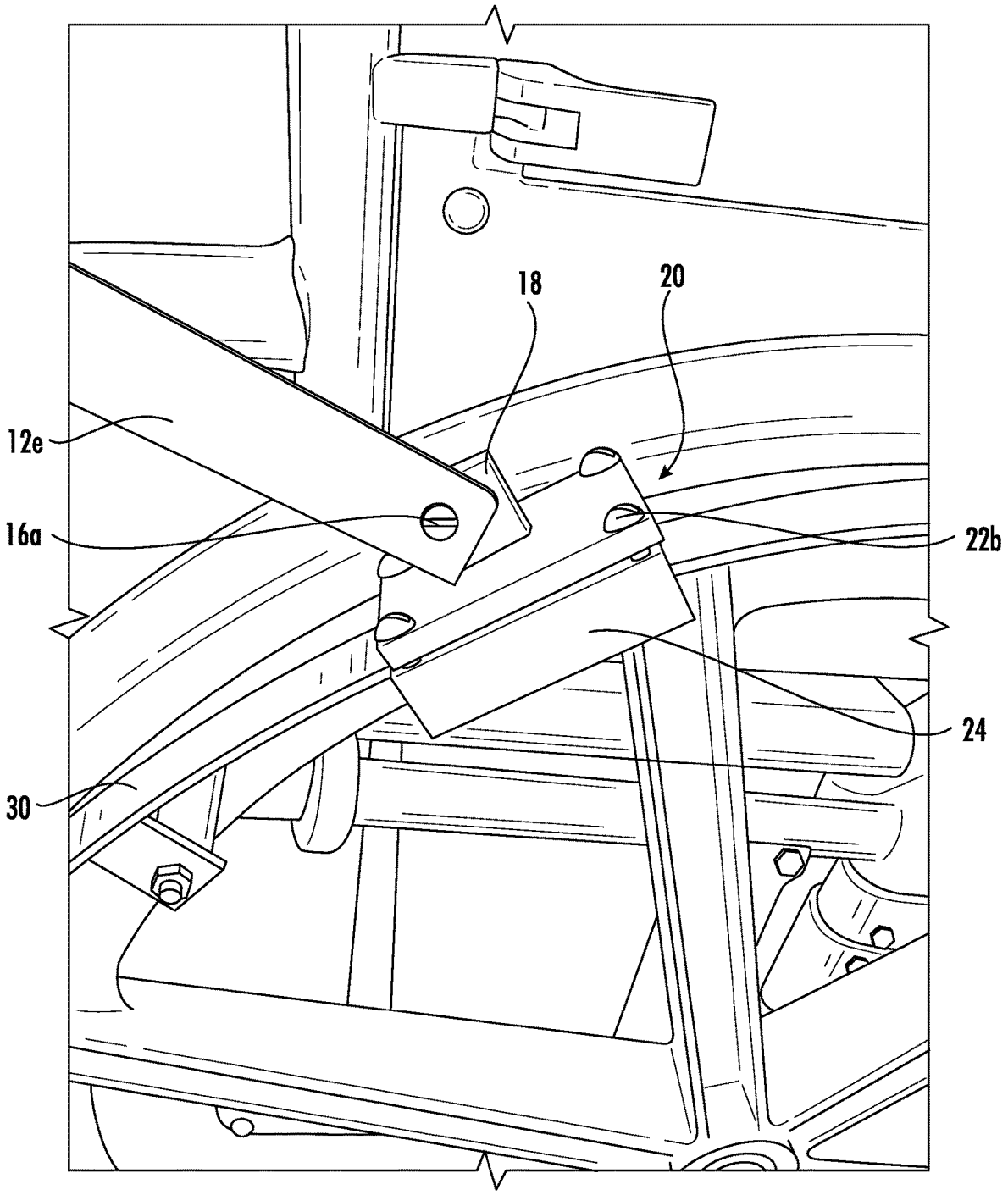
FIG. 5 is a side elevation detail view of the wheelchair propulsion assist device in FIG. 1.
Figure 6:
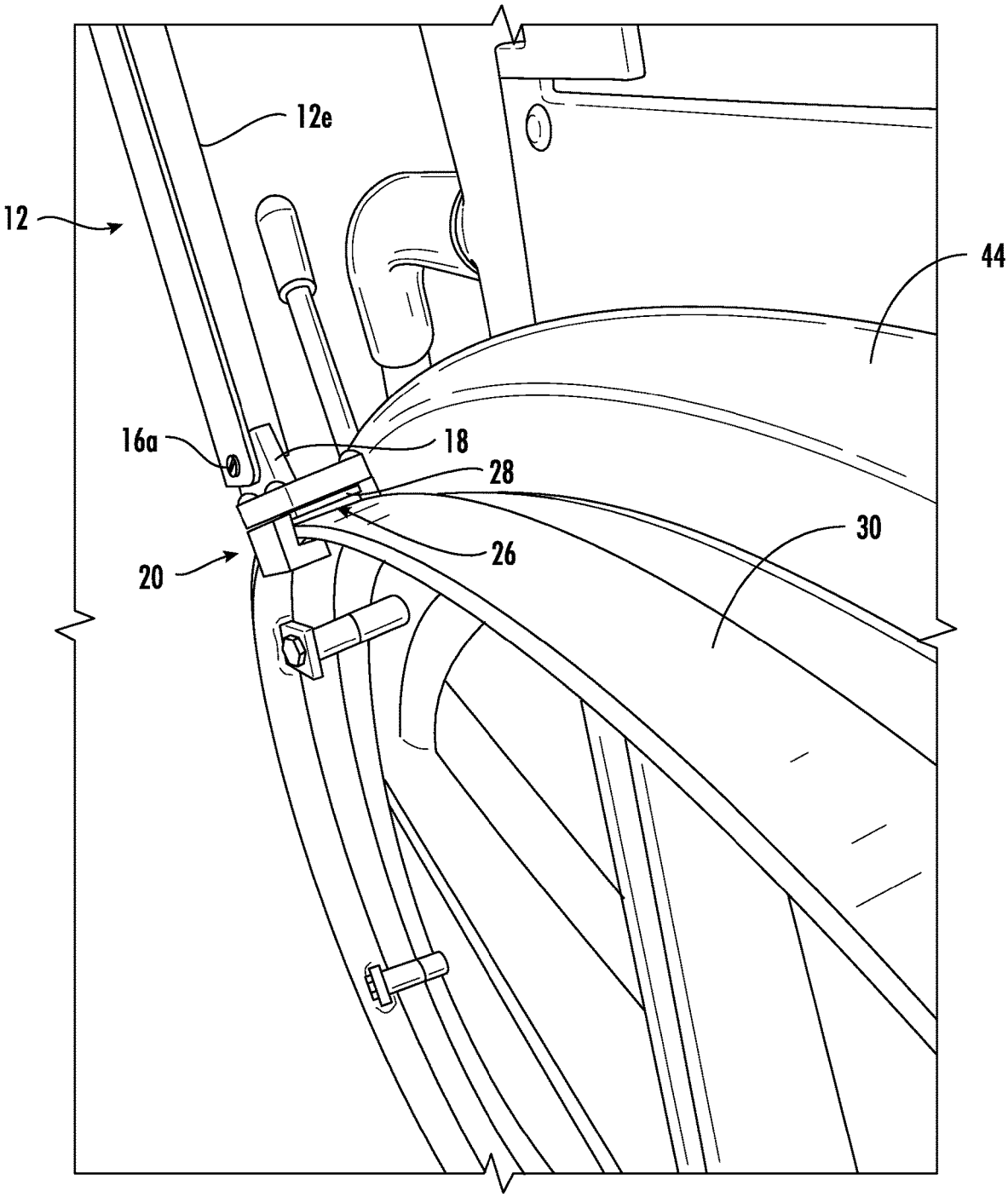
FIG. 6 is a back perspective view of the wheelchair propulsion assist device in FIG. 1.

The following is a list of reference labels used in the drawings to label components of different embodiments of the invention, and the names of the indicated components.

100 wheelchair propulsion assist device or assist
10 handle12 lever arm or arm
12*a* upper arm

12*b* adjustable fastener
12*c* adjustment hole
12*d* arm hole
12*e* lower arm
14 upper aperture
14*a* upper fastener
14*b* upper nut
16 lower aperture
16*a* lower fastener
16*b* lower nut
18 top flange
18*a* flange hole or hole
20 frame
22 top
22*a* frame fasteners
22*b* frame apertures
24 side wall
24*a* bottom lip
24*b* gap
26 channel
26*a* channel top wall or underside of top
28 rubber liner or grip material
30 replacement hand rim
40 wheelchair
42 OEM hand rim
44 drive wheel
46 wheelchair user or user
48 arm rest

DETAILED DESCRIPTION

Figure 12A:
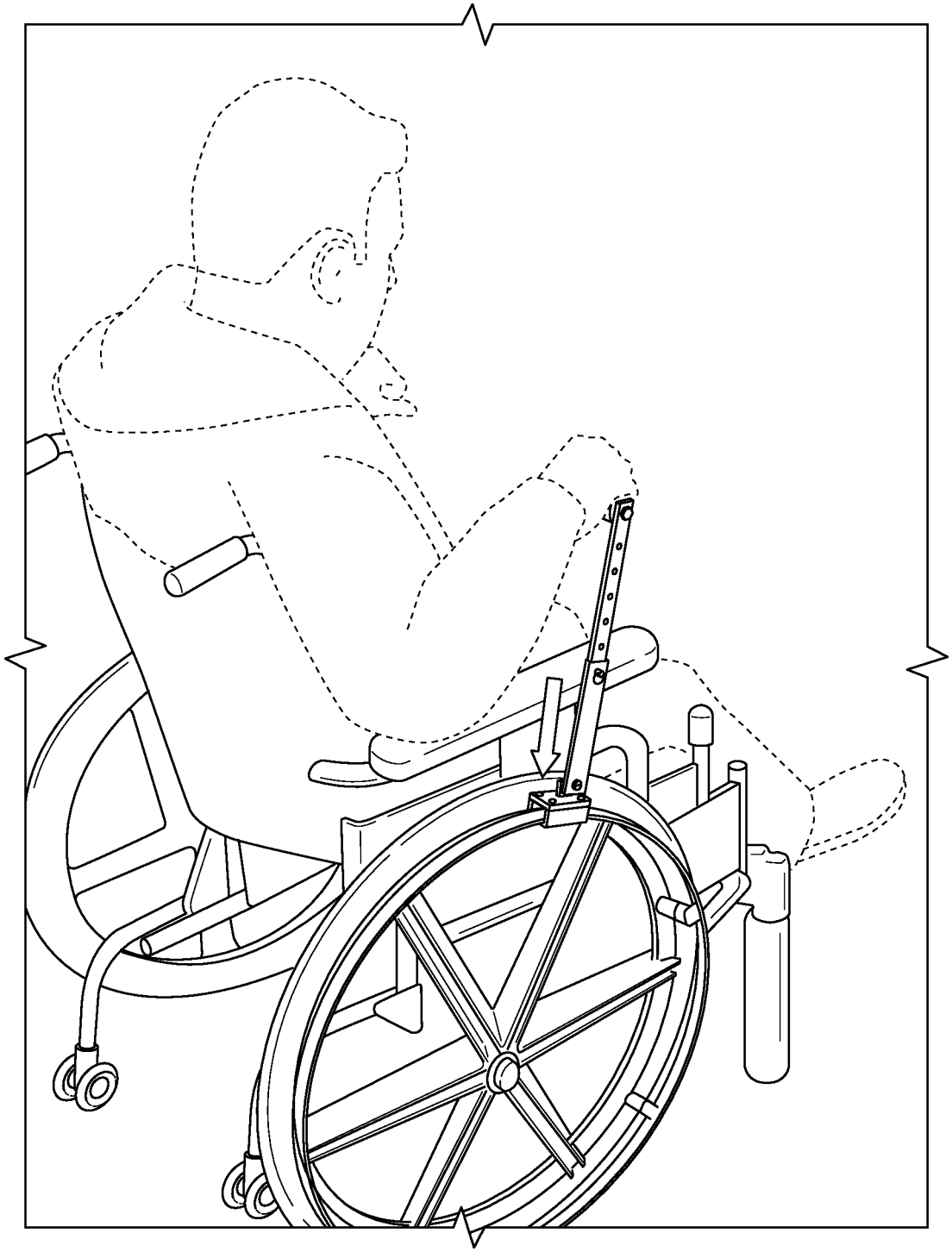
FIG. 12A is a back perspective view of the wheelchair propulsion assist device installed on a manual wheelchair, shown with a user positioning the lever arm in start position for forward propulsion.
Figure 12B:
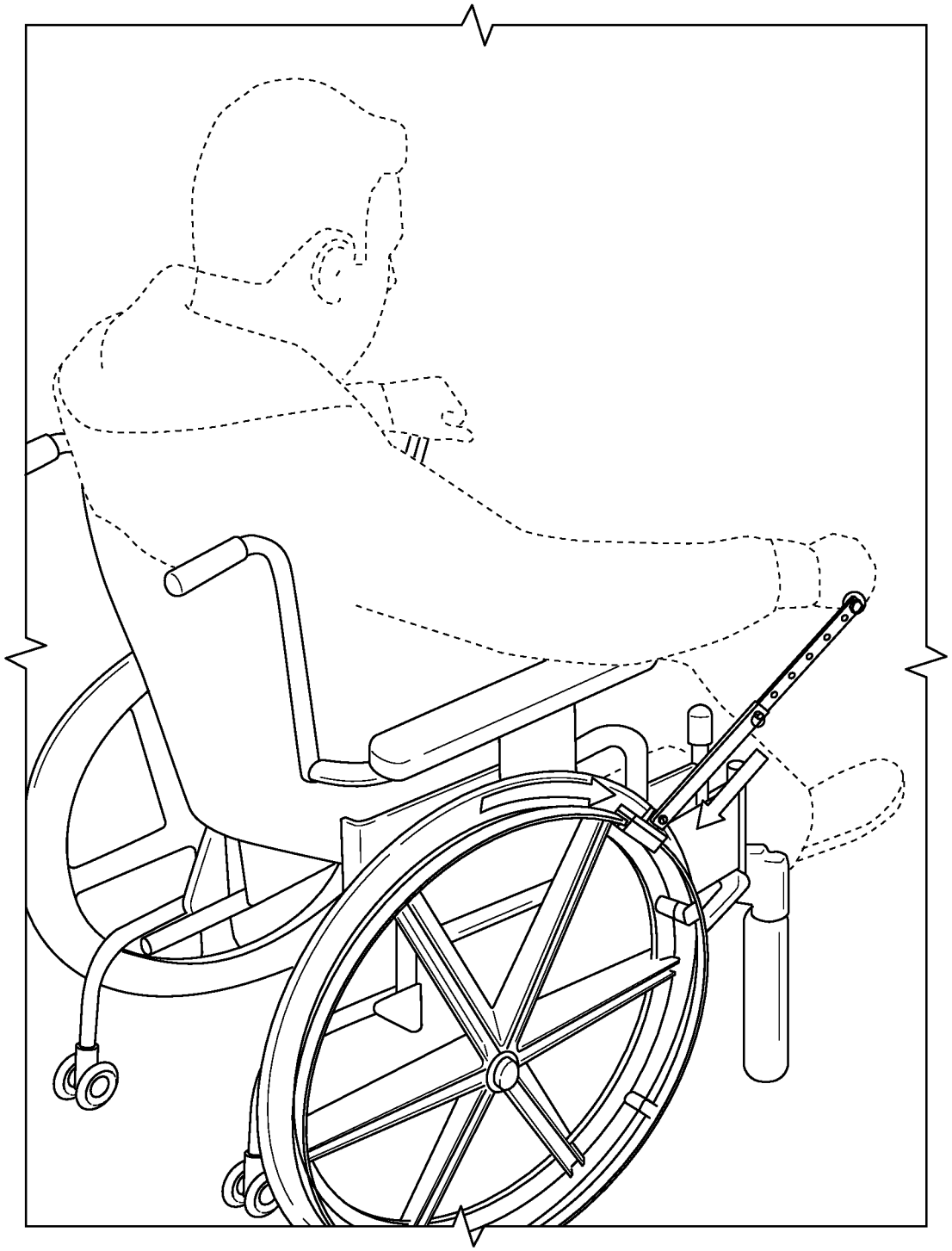
FIG. 12B shows the user in FIG. 12A with his arms extended and the lever arms moved away from the user's body.
Figure 12C:
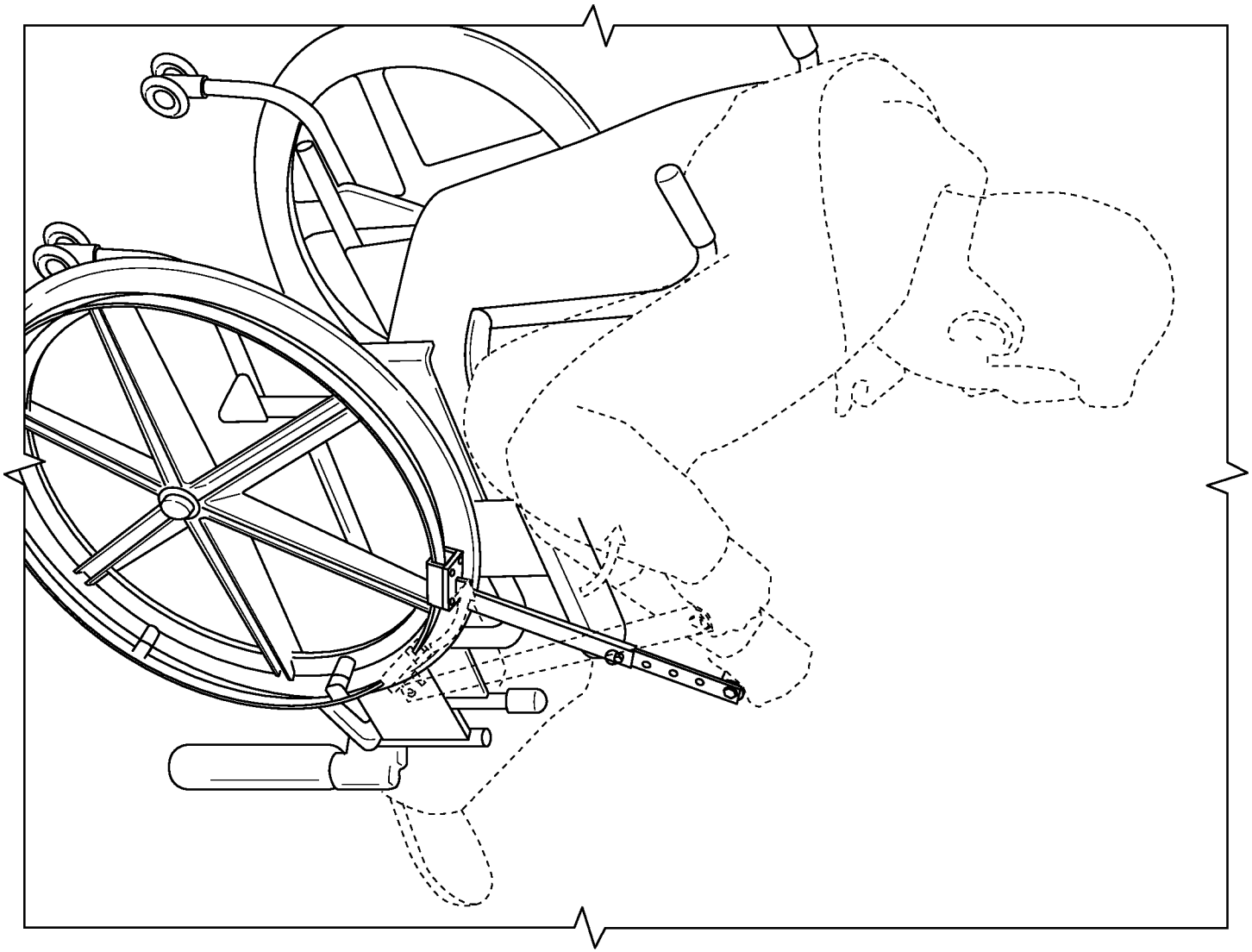
FIG. 12C shows the user in FIG. 12B repositioning his arms to the start position. The pressure from the user's hands on the lever arms push the frames against the hand rims thus turns the hand rims counterclockwise, propelling the wheelchair forward.
Figure 13:
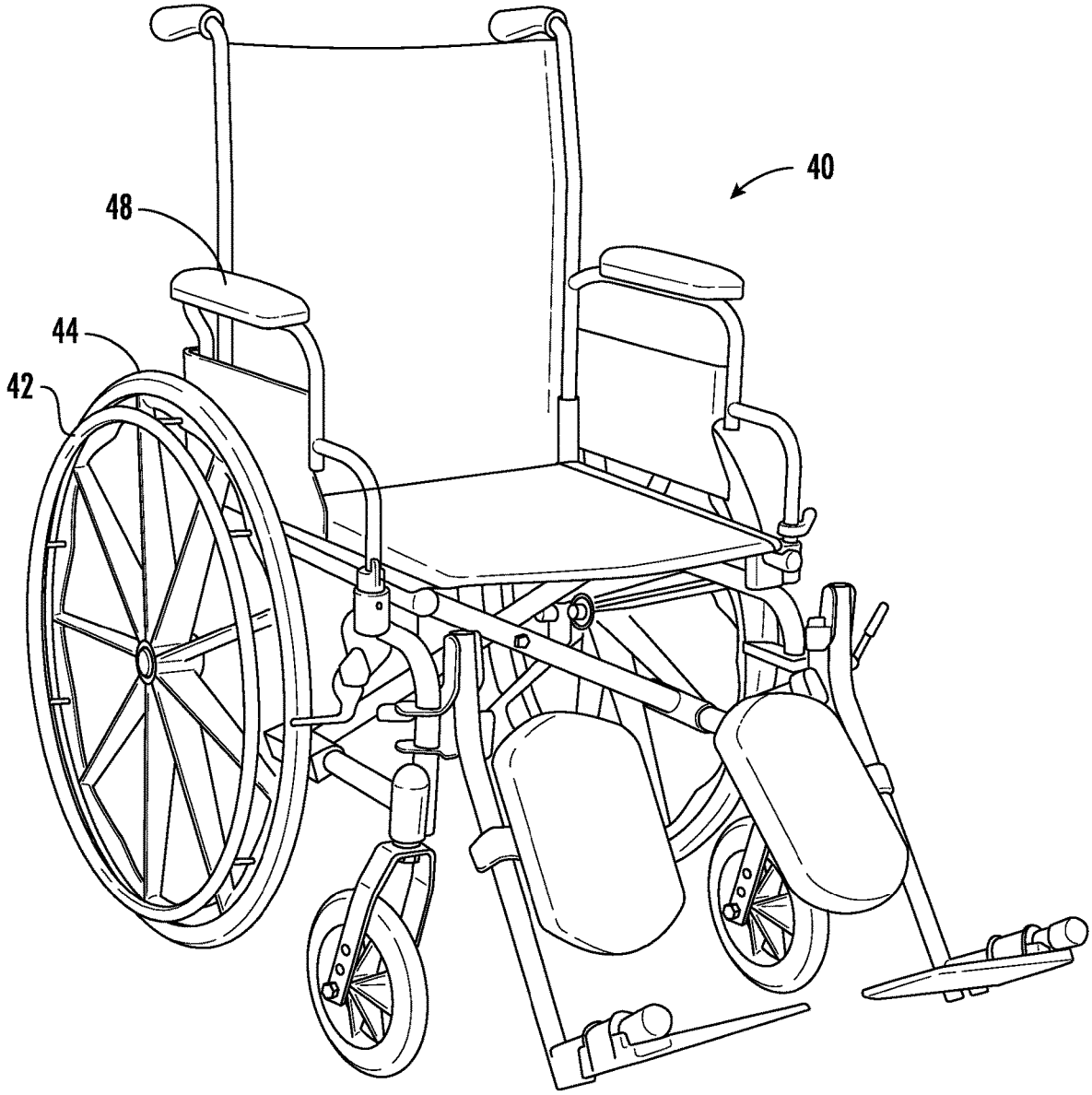
FIG. 13 PRIOR ART
FIG. 13 is a perspective view of a prior art manual wheelchair.

A manual wheelchair propulsion assist device or assist according to the invention 100 is shown in FIGS. 1-12C, with FIG. 13 showing a prior art folding wheelchair 40 with an original equipment manufacturer (OEM) hand rim 42. Turning now to the Figures, the assist 100 is comprised of a lever arm 12 with an adjustable length telescoping upper arm 12*a* portion and a lower arm 12*e*. The upper arm 12*a* formed with a plurality of adjustment holes 12*c* and is connected to the lower arm 12*e* by positioning an adjustable fastener 12*b* through an uppermost arm hole 12*d* in the lower arm 12*e* and through one of the plurality of adjustment holes 12*c* in the upper arm 12*a*. The lower arm 12*e* and upper arm 12*a* are adjusted according to a user's 46 perceived comfort. In other embodiments, the arm 12 is of a fixed length and non-adjustable, but offered with arms of varying length to allow the user 46 to pick an appropriate arm length as desired. An upper aperture 14 is formed into the upper arm 12*a*, and a handle 10 is secured thereto with an upper fastener 14*a* and upper nut 14*b*. A lower aperture 16 sized and shaped to receive a lower fastener 16*a* is formed at a lowermost end of the lever arm 12, in the Figures shown as a lower arm 12*e* and secured thereto by the lower fastener 16*a* and a lower nut 16*b*. The lower arm 12*e* and upper arm 12*a* shown in the Figures have U-shaped bodies, but could also have a square or other shape, with the lower aperture 16 formed as a single through hole or a pair of aligned holes receiving the lower fastener 16*a*, and a cutaway portion or flange formed at the lowermost end to allow space for the lever arm 12 to pivot forwards and backwards about the lower fastener 16*a*.

A frame 20 has a top 22, and a pair of side walls 24 affixed to the top 22, the side walls 24 sized and shaped to mirror one other. In the Figures, each side wall 24 is further formed with a receiving aperture aligned with a corresponding frame aperture 22*b* to allow the top 22 to be removably affixed to the side walls 24 via the frame fasteners 22*a*. The top 22 is formed with an upright or top flange 18, the top flange 18 formed with a flange hole or hole 18*a*. The lower aperture 16 of the lower arm 12*e* is aligned with the hole 18*a* and the lower fastener 16*a* couples the top flange 18 to the lower arm 12*e*. The top flange 18 and the lever arm 12 are in hingeable relationship, where the lever 12 at its lowermost end can rock forwards and backwards about the lower fastener 16*b* and in relation to the top flange 18 and where moving the lever arm 12 also moves the frame 20 forwards or backwards along a hand rim 30.

Figure 7:
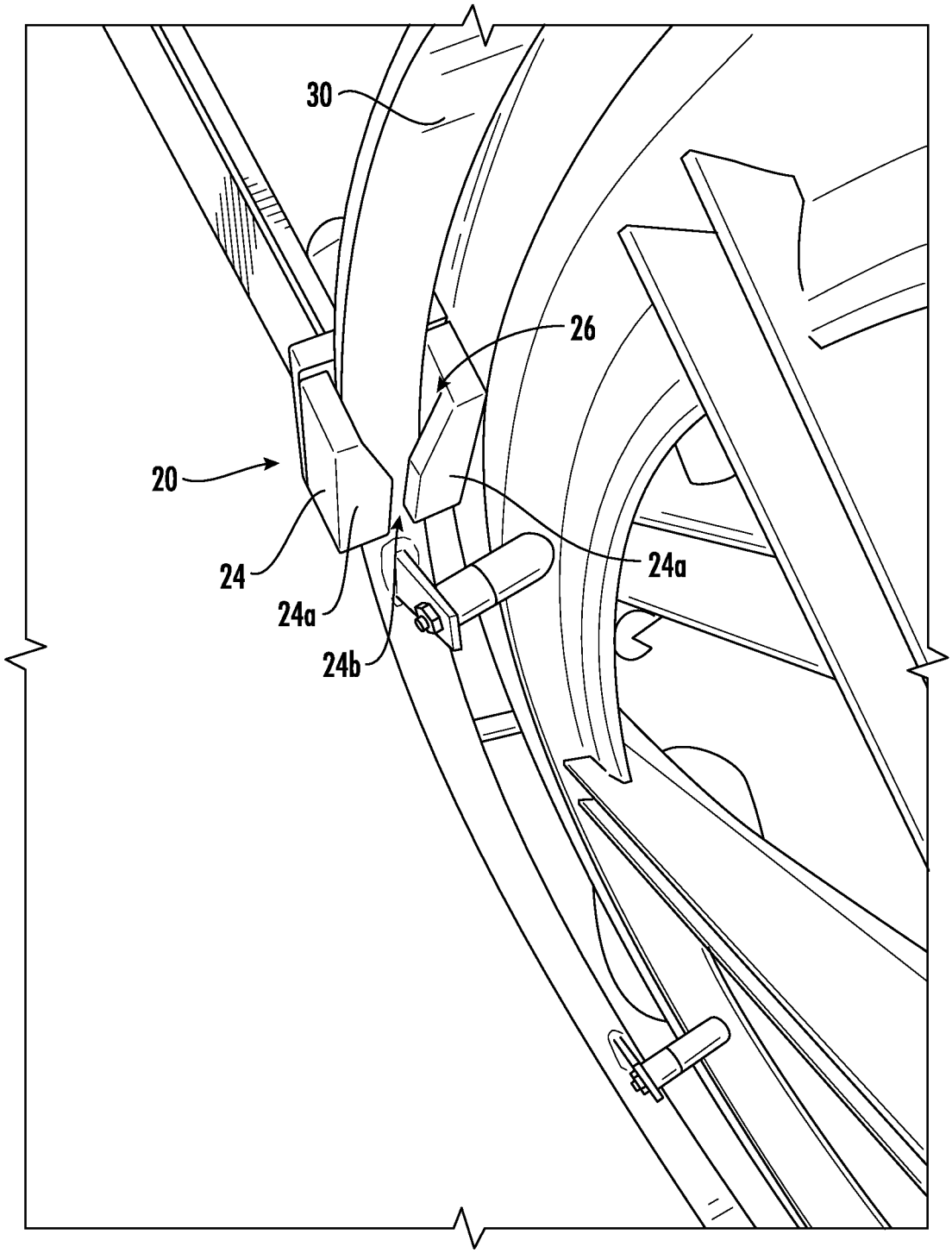
FIG. 7 is a bottom view perspective view of the wheelchair propulsion assist device in FIG. 1, showing an underside of the hand rim inside a channel.
Figure 8:
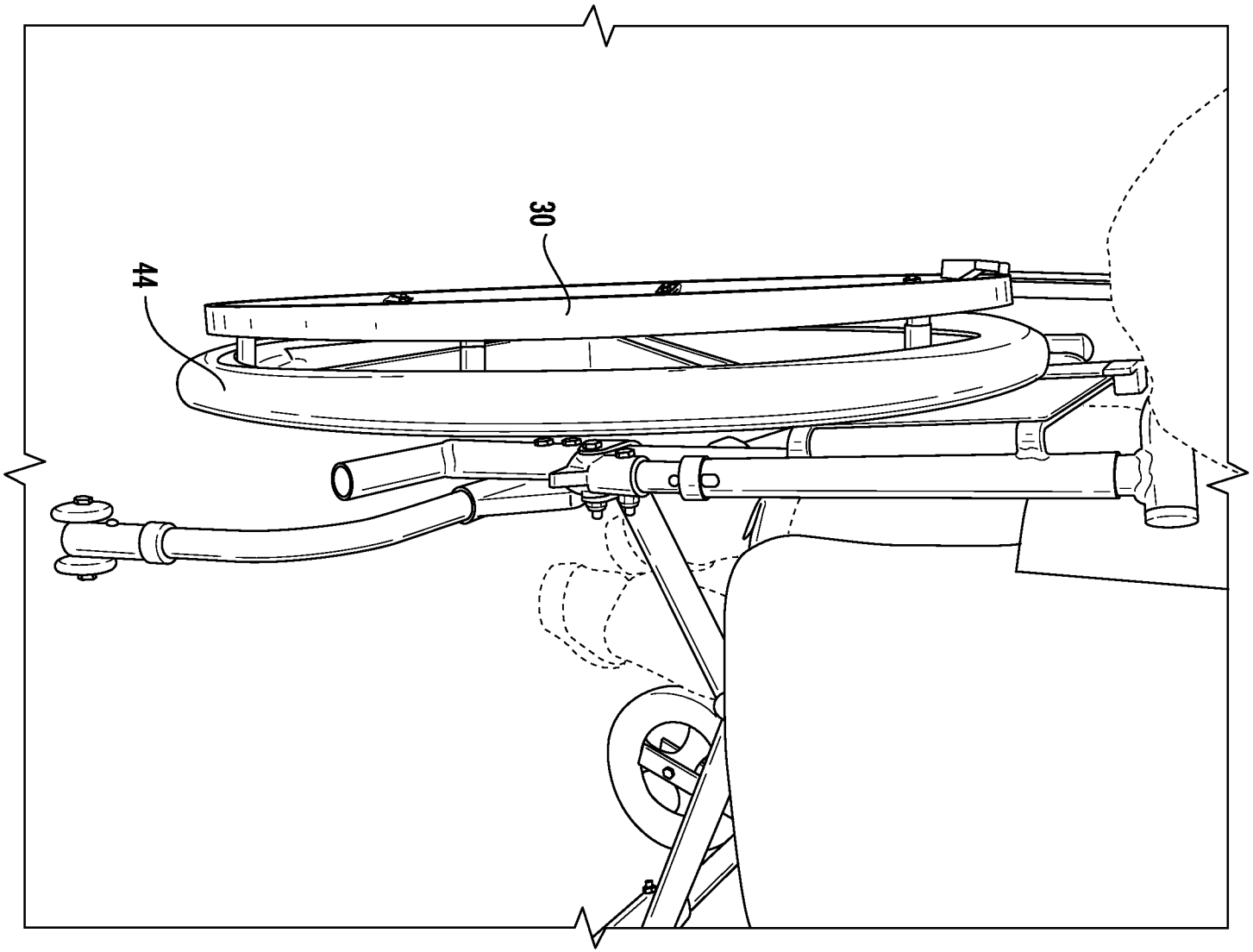
FIG. 8 is a partial back view of the rim in FIG. 1.
Figure 9:
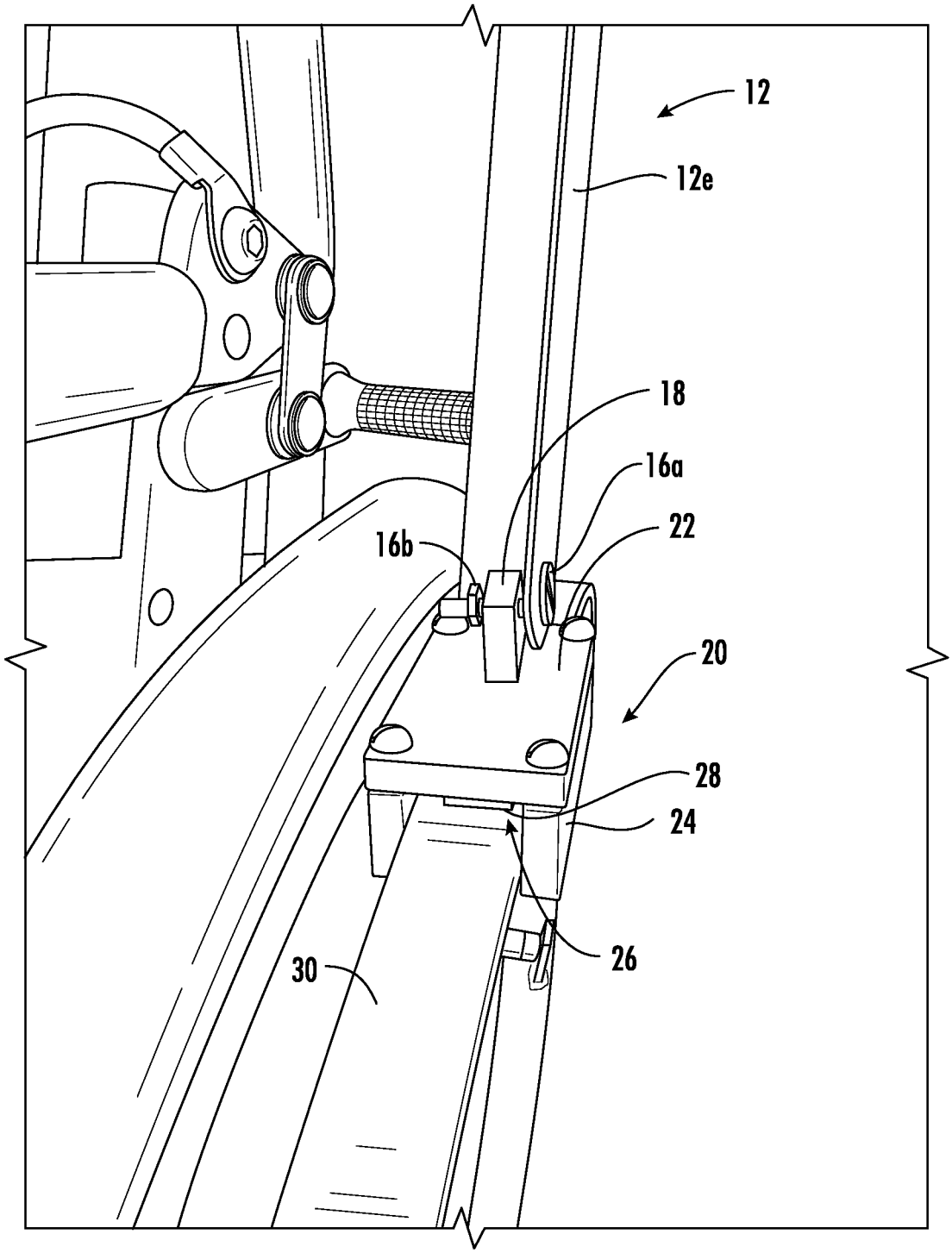
FIG. 9 is a detail back view of a lower portion of the lever arm and a frame of the wheelchair propulsion assist device.
Figure 10:
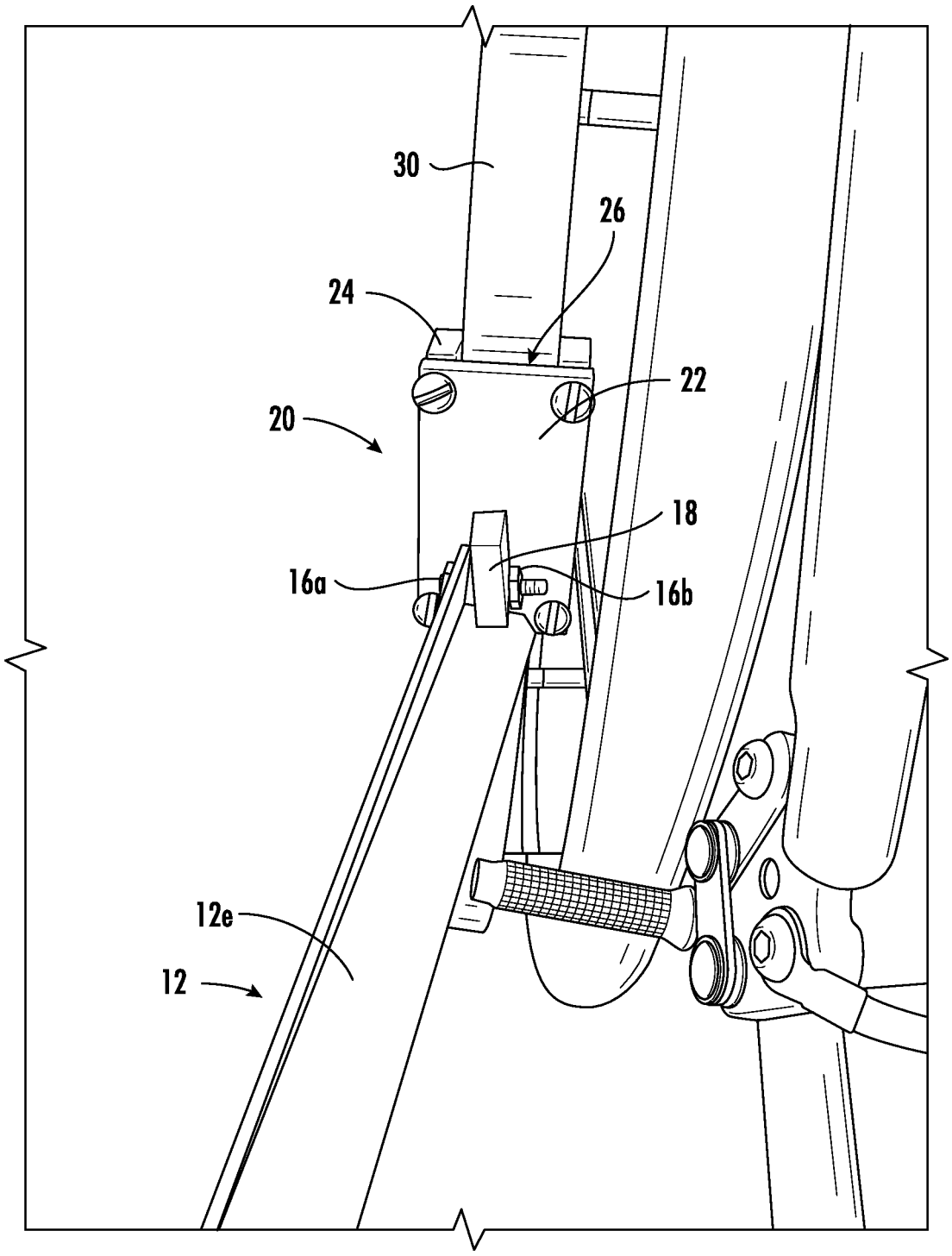
FIG. 10 is a top view of the lower portion of the lever arm and the frame of the wheelchair propulsion assist device.
Figure 11:
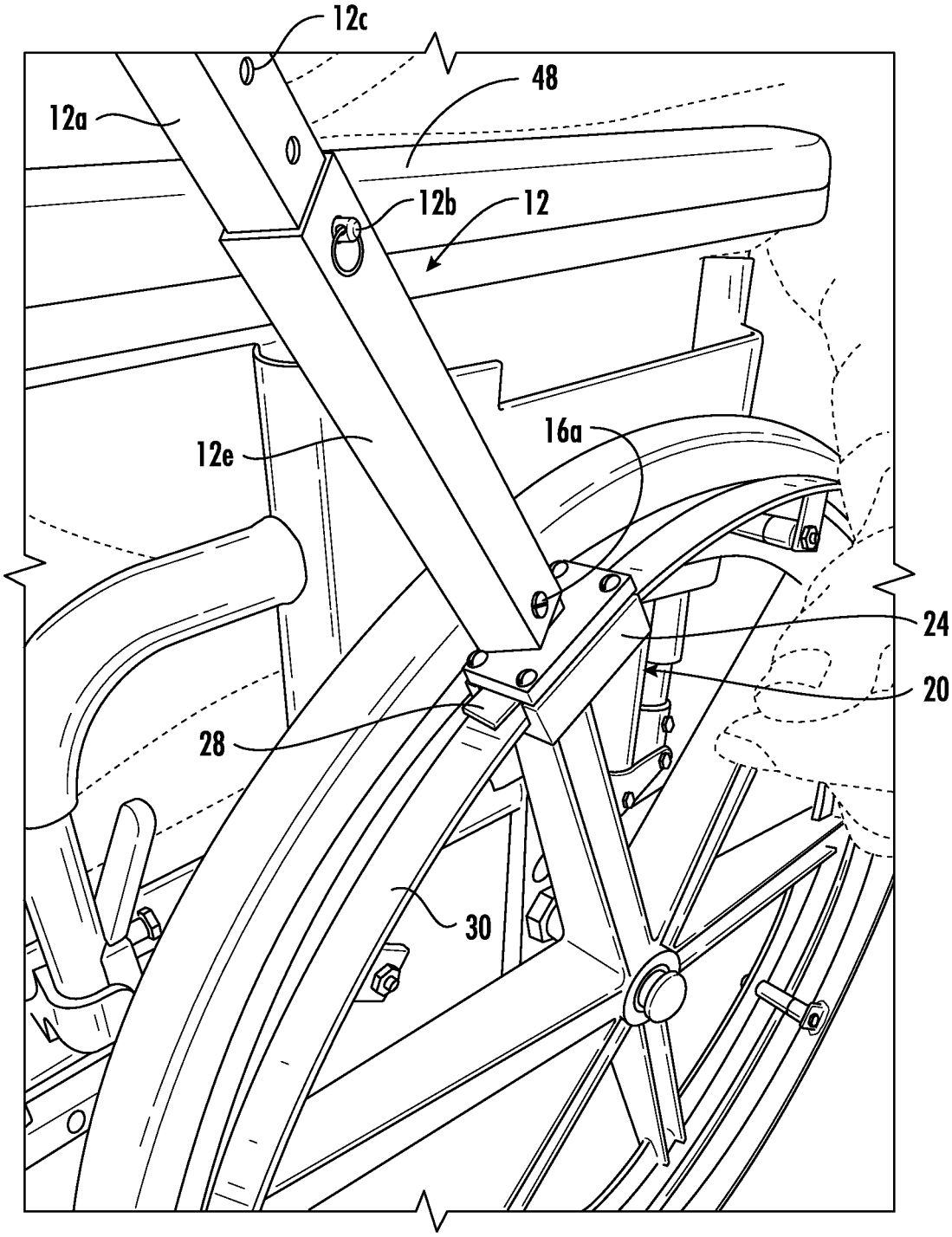
FIG. 11 is a detailed perspective view of the lower portion of the lever arm and frame of the wheelchair propulsion assist device.

Each side wall 24 has a bottom lip 24*a*, where the side walls 24 and the underside of the top 26*a* define an interior channel 26. In the embodiment shown in the Figures, the channel 26 is sized and shaped to receive the hand rim 30, as shown in FIG. 7, and the inventor notes that the hand rim 30 is shown with an approximately rectangular cross section about 22 inches wide, and the channel 26 thus mimics a same cross section and width, but with a larger overall height as compared to the hand rim 30 to allow the underside of the top 26*a* on a front facing side of the frame 20 to tilt forwards and backwards. In the embodiment shown in the Figures, the channel 26 has approximately 0.5 to 1 inch of clearance from the hand rim 30 contained therein. The channel 26 can also complement a shape of the OEM hand rim 42 shown in FIG. 13, which has an approximately circular cross section, again with some headroom between the underside of the top 26*a* and the OEM hand rim 42. Hence, while the assist 100 in the Figures is shown with the hand rim 30 in fact replacing the OEM hand rim 42 shown in FIG. 13, the frame 20 in other embodiments can be configured to be used with the existing OEM hand rim 42 by modifying a shape of the channel 26.

A gap 24*b* separates the bottom lip 24*a* of each side wall 24 and in FIG. 7, the gap 24*b* is shown with a rear end of the gap 24*b* flaring outwardly towards an outermost perimeter of the frame 20, the flaring rear end of the gap being wider relative to a front end of the gap 24*b* positioned towards a front of a wheelchair 40. The top 22 is shown in the Figures as being formed with four frame apertures 22*b* removably secured to the side walls 24 by four frame fasteners 22*a*, however the inventor notes that the frame 20 side wall and top configuration need only be such that the frame 20 is removably positionable onto the hand rim 30. The inventor notes that all the fasteners 14*a* 16*a* 22*a* shown in the Figures are threaded fasteners requiring simple tools such as a screwdriver and wrench in order to install or remove the assist 100 from the wheelchair 40, however, all the fasteners, including those for the hand rim 30 can also be configured as thumb screws, allowing the assist 100 to be installed or removed without tools. Thus, the frame 20 can be configured in many ways other than what is shown in the representative embodiment in the Figures.

Finally, a piece of rubber or grip material 28 or other similarly durable material with gripping capability, is affixed to the underside of the top 26*a*, facing the channel 26 and is typically a same length or longer length than the channel 26.

To install the assist 100 shown in the Figures, the handle 10, lever arm 12, top 22 and one side wall 24 are preassembled, with the remaining side wall 24 and frame fasteners 22*a* to be secured. The lever arm 12 length is adjusted by telescoping the upper arm 12*a* to a desired length and inserting the adjustable fastener 12*b* into the adjustment hole 12*c* and through the arm hole 12*d*. The OEM hand rim 42 is removed and the hand rim 30 is secured to each drive wheel 44 of the wheelchair 40 using existing fasteners of the OEM hand rim 42. The partially assembled frame 20 is positioned onto the hand rim 30. The remaining side wall 24 is then secured to the top 22 by coupling the frame fasteners 22*a* into the frame apertures 22*b*. The hand rim 30 is thus now positioned inside the channel 26 of the frame 20. Alternatively, for a frame 20 that is a single piece, the hand rim 30 is slipped into the channel 26 via the gap 24*b* and then rotated to position the top flange 18 and lever arm 12 upwards. The gap 24*b* provides a convenient method by which to install/uninstall the assist 100 without the need for tools and allows debris or moisture that might otherwise collect to be removed from the channel 26.

Turning to FIGS. 12A-C, to use the assist 100, a wheelchair user or user 46 grasps the handles 10 and bends his or her elbows, putting the lever arm 12 in a neutral or start position. The start position is one in which the user 46 positions the frame 20 in a desired location and the user 26 can choose to maneuver both lever arms 12 at the same time or each one individually, in the case where the user 46 wants to turn the wheelchair 40 into a different direction. Once the frame 20 is positioned into the desired start location, the user 46 applies downwards force on the lever arms 12, which causes the frame 20 to push downwards, and thus pressing the grip material 28 against the rim 30. The frame 20 is able to tilt forwards and backwards when installed on the rim 30, and thus the start position chosen by the user 46 may cause the frame 20 to tilt forward or backwards, but with the grip material 28 compressed between the underside of the top 26*a* and the rim 30. As the user 46 straightens his or her arms, the rims 30 turn along with the drive wheels 44 to which they are attached, causing the wheelchair 40 to move forward. To move backwards, the user's start position is with arms extended and pressure exerted against the rim 30. The user 46 bends his or her elbows again and relaxes the downward pressure on the lever arms 12, causing the frame 20 to slide backwards on the rim 30 and resume the start position and thus releasing the hand rim 30 from the grip material 28. The frame 20 is repositioned and the user 46 again extends his or her arms to move the drive wheels 44. If the user 46 wants to turn right, the user 46 engages a left side lever arm to turn a left side drive wheel to an appropriate position. To move backwards, the user 46 positions the frame 20 in a desired location on the hand rim 30, and instead tilts the frame 20 such that a read end of the frame 20 compresses the grip material 28 against the hand rim 30 to move the drive wheels in a backwards direction.

The inventor's assist 100 has many advantages over the prior art. It is comprised of few parts and is easily installed and uninstalled, as desired. This design is economical to manufacture and maintain. The components are all made of metal in the embodiment shown, however are lightweight and thus do not add any significant extra weight to the wheelchair that would further burden the user 46. In the embodiment using the existing OEM hand rim 42, removal of the assist 100 allows the user 46 the full option of propelling the wheelchair using existing means. The inventor notes that his hand rim 30 can also be used without the assist 100 to hand propel the wheelchair 40 and his hand rim 30 design maximizes the surface area by which the hand rim 30 contacts the underside of the top 26*a* for maximum propulsion of the drive wheels 44. In the case of the OEM hand rim 42, the channel 26 is most optimally configured with an elongated cross section to minimize lateral shifting of the OEM hand rim 42 inside the channel 26, which also optimizes the compression force of the frame 20 against the OEM hand rim 42 to propel the drive wheels 44. For the hand rim 30 shown in the embodiment in the Figures, side to side movement of the hand rim 30 within the chamber 26 is less critical given the flattened cross section of the hand rim 30, and thus less exacting machining is required for the frame 20, reducing manufacturing complexity and cost. The inventor believes his assist 100, sold as a kit with or without the hand rim 30, is ideal for retrofitting existing wheelchairs, and provides sufficient mechanical leverage allowing the most feeble-strength user 46 to nevertheless propel the wheelchair 40 easily and independently.

It is to be understood that the above-described arrangements are only illustrative of the application of the principles of the present invention. Numerous modifications and alternative arrangements may be devised by those skilled in the art without departing from the scope of the present invention. For instance, the lever arms 12 are currently shown as having a standard length, but they could easily be configured to be telescoping or otherwise adjustable to accommodate different body sizes, etc. With the exception of the grip material 28, the lever arms 12, handles 10 and the frame 20, currently shown in the Figures as being made of metal, can also be made of any durable material including structural plastic, or a combination of materials could be used together for the assist 100 to minimize weight, decrease cost, etc. as desired. The inventor notes that his assist 100 is lightweight, easy to use and install and requires limited tools and learning time to use. He believes his simple, elegant solution is both cost effective and ergonomic, allowing anyone of any income level a simple and useful way to manually propel an existing wheelchair. In particular, the assist 100 permits the user to have a tight turning radius to redirect the wheelchair 40 as desired, something that current assist devices and electric chairs currently cannot perform. As the assist 100 is completely manual in nature, the user 46 has complete control over the movement, direction and speed of the wheelchair, and additionally, the frame 20 can also be used for supplemental braking or maintenance of position on hills, or other non-level surfaces. The inventor notes too that the hinging relationship between the lever arm 12 and the frame 20 can be configured in many other ways, and the only criticality in any new arrangement is that the frame 20 maintain its ability to clamp onto the hand rim 30 or OEM hand rim 42 and then lift off when the lever arm position is adjusted. The tilting action of the frame 20 is not the only way this engagement/disengagement of the frame to the hand rim can be performed, and the inventor notes there are other ways this can still be implemented and not change the overall function of the assist 100.

I claim:

1. A propulsion assist device for a wheelchair having a manual hand rim affixed to a drive wheel, the propulsion assist device comprising:

a lever arm having an upper end and a lower end;

a lower aperture formed into the lower end of the lever arm;

a frame having a top affixed to a pair of opposed side walls in spaced apart relationship, an underside of the top and the spaced apart relationship of the side walls defining a channel having a rim opening sized and shaped to receive the manual hand rim of the wheelchair and allow the manual hand rim to rotate therein, and a lowermost channel opening perpendicular to the rim opening and opposite the underside of the top;

a bottom lip formed on at least one side wall of the pair of opposed side walls and oriented so as to constrict the channel opening to secure the manual hand rim within the channel;

a grip material positioned on the underside of the top inside the channel;

a flange extending from the top of the frame, the flange formed with a flange hole; and a lower fastener sized and shaped to couple the lower end of the lever arm to the flange through the flange hole and the lower aperture;

wherein the lower fastener pivotably couples the lever arm to the flange.

2. The propulsion assist device in claim 1, further comprising a handle sized and shaped to be gripped by a human hand affixed to the upper end of the lever arm.

3. The propulsion assist device in claim 1, wherein the lever arm is further comprised of a telescopically adjustable upper arm and a lower arm, whereby a length of the lever arm is adjustable.

4. The propulsion assist device in claim 1, wherein each of the side walls is formed with a bottom lip in spaced apart relationship with one another so as to create a gap between the bottom lips.

5. The propulsion assist device in claim 1, wherein the lower end of the lever arm having the lower aperture is a flange.

6. The propulsion assist device in claim 1, wherein the top is further comprised of a frame aperture and at least one side wall is further comprised of a hole aligned with the frame aperture, the frame aperture and the hole sized and shaped to receive a frame fastener, removably coupling the top to the at least one side wall.

7. The propulsion assist device in claim 1, further comprising a replacement rim having a flattened profile adapted to replace an original manufacturer hand rim of the wheelchair using existing fasteners of the original manufacturer hand rim.

8. The propulsion assist device in claim 7, wherein the channel is sized and shaped to receive the replacement rim.

9. A propulsion assist kit for a manual wheelchair having a hand rim, the kit comprising:

a lever arm having an upper handle end and a lower flange; and a c-shaped frame pivotably affixed to the lower flange;

wherein the c-shaped frame is further comprised of a channel having a rim opening and a channel opening, the channel sized and shaped to receive the hand rim through the channel opening and the hand rim rotates within the rim opening; and wherein the c-shaped frame is further comprised of a removable side wall having a bottom lip oriented so as to constrict the channel opening, securing the hand rim within the channel.

10. The propulsion assist kit in claim 9, further comprising a replacement rim having a flattened rim profile and adapted to replace the hand rim of the wheelchair by using a same set of fasteners as the hand rim of the wheelchair.

11. The propulsion assist kit in claim 10, wherein the c-shaped frame is further comprised of a lower gap sized and shaped to receive the replacement rim, whereby the c-shaped frame can be installed onto the replacement rim without tools.

* * * * *